US008266824B2

(12) United States Patent
Steiner

(10) Patent No.: US 8,266,824 B2
(45) Date of Patent: Sep. 18, 2012

(54) CONDENSATION DRYER HAVING A HEAT PUMP AND METHOD FOR THE OPERATION THEREOF

(75) Inventor: Dietmar Steiner, Welzheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 584 days.

(21) Appl. No.: 12/519,820

(22) PCT Filed: Dec. 18, 2007

(86) PCT No.: PCT/EP2007/064127

§ 371 (c)(1),
(2), (4) Date: Jul. 2, 2009

(87) PCT Pub. No.: WO2008/080831

PCT Pub. Date: Jul. 10, 2008

(65) Prior Publication Data

US 2010/0011615 A1 Jan. 21, 2010

(30) Foreign Application Priority Data

Dec. 28, 2006 (DE) ..... 10 2006 061 737

(51) Int. Cl.
*F26B 5/08* (2006.01)

(52) U.S. Cl. ..... 34/595; 34/601; 34/606; 34/610; 68/177; 8/152; 62/304; 62/310

(58) Field of Classification Search ..... 34/86, 90, 34/92, 595, 601, 606, 610, 242; 68/177; 8/152; 62/304, 310
See application file for complete search history.

(56) References Cited

U.S. PATENT DOCUMENTS

| | | | | |
|---|---|---|---|---|
| 2,713,995 | A * | 7/1955 | Arkoosh et al. | 165/258 |
| 3,734,810 | A * | 5/1973 | Davis | 165/240 |
| 6,321,460 | B1 * | 11/2001 | Jin | 34/77 |
| 7,055,262 | B2 * | 6/2006 | Goldberg et al. | 34/86 |
| 2006/0179676 | A1 * | 8/2006 | Goldberg et al. | 34/77 |
| 2010/0011615 | A1 * | 1/2010 | Steiner | 34/493 |
| 2010/0154248 | A1 * | 6/2010 | Stolze | 34/493 |
| 2011/0119952 | A1 * | 5/2011 | Nawrot et al. | 34/427 |
| 2011/0173838 | A1 * | 7/2011 | Nawrot et al. | 34/468 |
| 2011/0178653 | A1 * | 7/2011 | Nawrot et al. | 700/300 |
| 2011/0198405 | A1 * | 8/2011 | Krausch et al. | 236/44 C |
| 2011/0209484 | A1 * | 9/2011 | Krausch et al. | 62/79 |

FOREIGN PATENT DOCUMENTS

| | | | |
|---|---|---|---|
| DE | 4023000 | C2 | 2/2003 |
| DE | 19738735 | C2 | 2/2003 |
| JP | 200527733 | A | 2/2005 |
| JP | 2007306960 | A | 11/2007 |

* cited by examiner

*Primary Examiner* — Stephen M. Gravini
(74) *Attorney, Agent, or Firm* — James E. Howard; Andre Pallapies

(57) ABSTRACT

A condensation dryer is provided that includes a drying chamber for items to be dried, a process air circuit via which fan driven process air can be conducted across the items to be dried, and a heat pump circuit for alternately heating and cooling the process air. A secondary fluid circuit is provided between the process air circuit and the heat pump circuit.

13 Claims, 1 Drawing Sheet

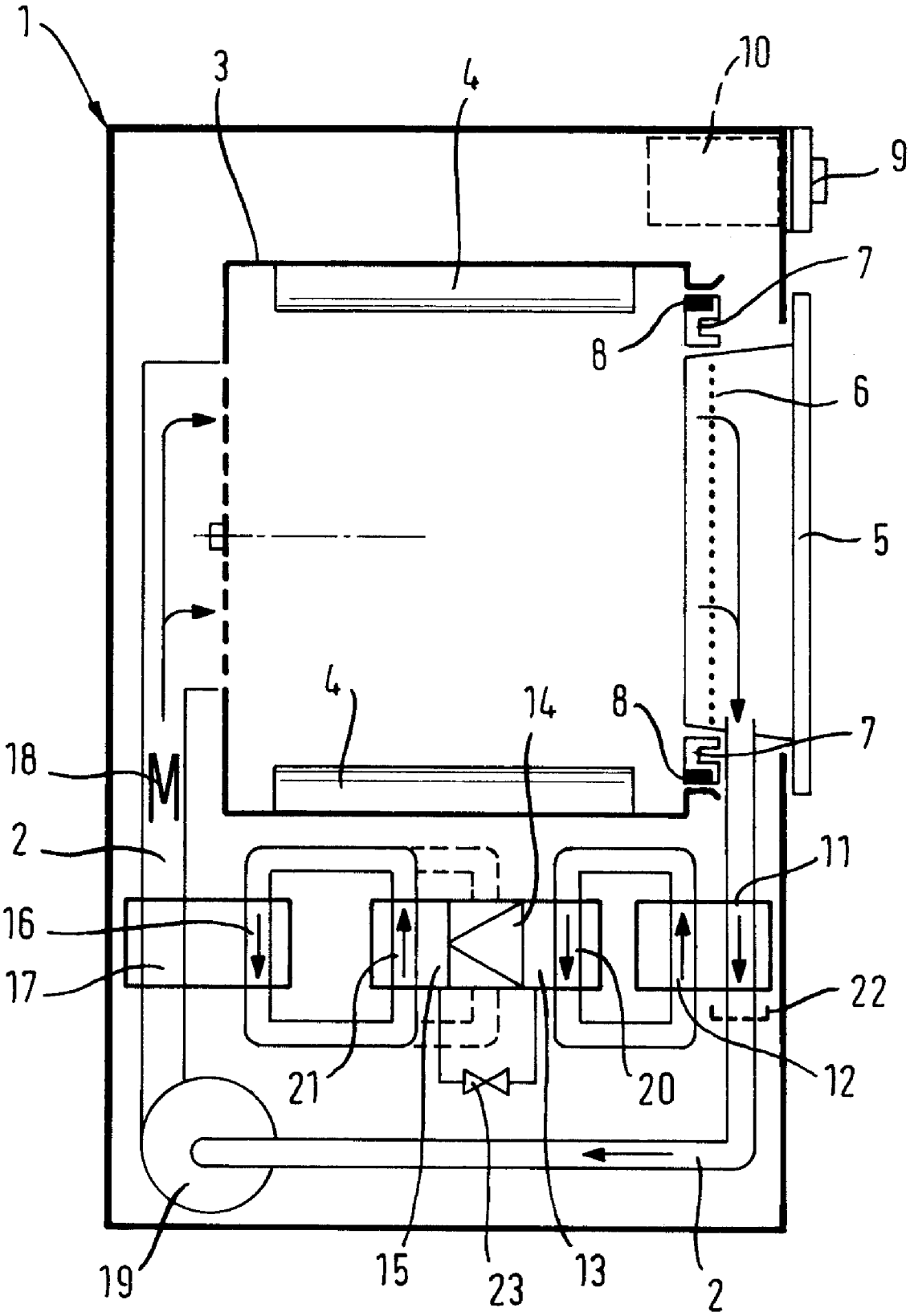
1
3
4
10
9
7
8
6
5
4
14
8
7
18
M
2
11
16
17
22
21
20
12
19
15
23
13
2

CONDENSATION DRYER HAVING A HEAT PUMP AND METHOD FOR THE OPERATION THEREOF

BACKGROUND OF THE INVENTION

The invention relates to a condensation dryer with a drying chamber for items to be dried, a process air circuit, in which the process air can be conducted across the items to be dried by means of a fan, and a heat pump circuit for alternately heating and cooling the process air.

The invention further relates to a method for operating such a condensation dryer.

Laundry dryers, the operating principle of which is based on the condensation of the evaporated moisture from the laundry by means of warm process air—known as condensation dryers—are very popular because they generate no moisture-laden exhaust air and require no hose to vent this exhaust air from a building in which such a laundry dryer is installed. Condensation dryers can therefore be employed in internally located bathrooms or utility rooms of larger residential complexes.

In a condensation dryer, process air is directed by means of a fan via a heating device into the drum containing the damp laundry, the drum acting as a drying chamber. The hot air removes moisture from the items of laundry to be dried. After passing through the drum, the moist process air is directed into a heat exchanger, upstream of which a fluff filter is as a rule located.

In the heat exchanger (e.g. air/air heat exchanger) the moist process air is cooled, with the result that the water contained in the moist process air is condensed out. The condensed water is then collected in a suitable container. The cooled and dried air is then once more directed to the heating device and subsequently to the drum. In general the heat exchanger can be easily removed for occasional cleaning of dried-on fluff (microfibers from the laundry items).

Said drying process is very energy-intensive, since the heat removed to cool the process air in the heat exchanger is lost to the process from the energy perspective. By using a heat pump which at least partially feeds this removed heat back to the process air, it is generally possible to save some 50% of the energy used. In the case of a known condensation dryer equipped with a heat pump, cooling of the warm, moisture-laden process air takes place in an evaporator of the heat pump. A coolant from the heat pump evaporated through the transfer of heat from the process air is compressed in a compressor and directed to a condenser, where it releases heat through condensation, said heat in turn being used to heat the process air before entry into the laundry drum. Downstream of the condenser the coolant flows through a throttle, where its pressure is reduced to a lower level, so that it can evaporate in the evaporator, into which it subsequently passes again, while again absorbing heat.

DE 40 23 000 C2 discloses a laundry dryer with a heat pump wherein there is arranged in the process air channel between the condenser and the evaporator an incoming air orifice which can be closed by means of a controllable closure mechanism.

DE 197 38 735 C2 discloses a condensation dryer with a closed process air circuit, which is equipped with a heat pump. The heat pump is embodied as a device operating according to the absorber principle, the absorber of which forms a third heat exchanger, through the primary circuit of which coolant flows and via the secondary circuit of which the process air flowing away from the second heat exchanger is once again supplied to the secondary circuit of the first heat exchanger.

In condensation dryers known from the prior art, the heat exchange takes place directly between heat pump and process air.

The use of a heat pump gives rise to the problem of soiling of both heat exchangers in the heat pump (evaporator, condenser), especially the evaporator, by entrained fluff. Unfortunately the fluff contained in the process air cannot be completely separated out in the fluff filter, since an improvement in the filtration effectiveness of the fluff filter is accompanied by an increase in its flow resistance. The fluff is deposited as a film, for example, on the cooling fins of the heat exchanger, thus increasing the heat transmission coefficient, as a result of which the efficiency of the heat exchanger is reduced.

As the evaporator and condenser of a heat pump are generally permanently installed, and connected to the compressor by means of pressure-tight piping, they cannot be removed for cleaning.

A further problem lies in the pipework between heat exchangers and compressor. Modern heat pumps frequently use carbon dioxide as a coolant. This very environmentally friendly coolant works only at extremely high pressure (up to 145 bar). Very exacting requirements thus apply to the pressure-tightness of the coolant circuit. In addition, the heat exchangers cannot be optimally positioned in the process airstream, since otherwise the coolant lines become too long. Furthermore, the industrial manufacture of the system comprising compressor, evaporator and condenser together with the high pressure lines that connect them is very difficult to realize cost-effectively. Similar problems arise in the case of other coolants employed in heat pumps.

These disadvantages of known condensation dryers with heat pumps result in reduced useful life, and in a less favorable energy balance due to poor cleaning options for the heat exchangers.

BRIEF SUMMARY OF THE INVENTION

An object of the invention is thus to provide a condensation dryer with a heat pump, which dryer has an increased useful life and offers the possibility of easier cleaning.

The subject matter of the invention is thus a condensation dryer with a drying chamber for items to be dried, a process air circuit, in which the process air can be conducted across the items to be dried by means of a fan, and a heat pump circuit for alternately heating and cooling the process air, in which condensation dryer at least one secondary fluid circuit is located between the process air circuit and the heat pump circuit.

The subject matter of the invention is also a method for operating a condensation dryer with a drying chamber for items to be dried, a process air circuit, in which the process air is conducted across the items to be dried by means of a fan and in the course thereof alternately heated and cooled by a heat pump circuit, wherein there is disposed between the process air circuit and the heat pump circuit at least one secondary fluid circuit via which heat is exchanged between the heat pump circuit and the process air.

In a preferred embodiment of the inventive condensation dryer, the secondary fluid circuit contains a secondary coolant which is a substance that is fluid at room temperature and normal pressure. The secondary coolant in a secondary fluid circuit is in this case preferably at least one substance from the group comprising water, simple alcohols and polyalcohols and glycol ether. Suitable polyalcohols are, for example ethylene glycol and propylene glycol. Suitable glycol ethers are, for example, ethylene glycoldimethylether and propylene glycoldimethylether or the corresponding monoether. Water is most preferably used as the secondary coolant.

In addition, a primary coolant is preferably used in the heat pump circuit, said primary coolant being selected from the group comprising propane, isobutane, carbon dioxide and fluorohydrocarbon compounds. Here, the heat pump preferably has an evaporator, a condenser, a compressor and a throttle. The compressor is generally located in the flow direction of the primary coolant between the evaporator and the condenser. In general an expansion valve, also referred to as a throttle, is additionally located in the heat pump in the flow direction of the primary coolant between the condenser and the evaporator. The primary coolant used in the heat pump preferably circulates in the heat pump circuit with a turbulent flow. A turbulent flow can be established by means of a suitable embodiment of a flow channel and/or by means of a suitable drive means (e.g. compressor).

Between the heat pump and the process air circuit, the inventive condensation dryer contains at least one secondary fluid circuit. That is to say that a first or, as the case may be, second secondary fluid circuit is located at least between the process air circuit and the heat-absorbing heat exchanger (in particular evaporator) of the heat pump or between the process air circuit and the heat-emitting heat exchanger (in particular condenser) of the heat pump. One or two secondary fluid circuits are preferably located between the heat pump and the process air circuit. Very particularly preferably, the inventive condensation dryer has a first secondary fluid circuit and a second secondary fluid circuit.

A secondary coolant which is generally different from the primary coolant circulates in each secondary fluid circuit.

In the inventive condensation dryer, the heat pump thus imparts its cooling power or heating power to the process air circuit of the condensation dryer via a secondary coolant (also known as "secondary fluid") in at least one secondary fluid circuit. The cooling or, as the case may be, heating power is thus generated centrally in a heat pump which in the case of the inventive condensation dryer can be very compact.

If in one embodiment of the invention a secondary fluid circuit is located between the process air circuit and the evaporator of the heat pump, the warm, moisture-laden process air is cooled in a first heat exchanger, in which the process air circuit and the first secondary fluid circuit are ideally in contact via a wall with good heat-conducting properties. The moisture contained in the process air condenses and is generally collected in a suitable collection vessel, e.g. a tray, from where it can be disposed of.

If in one embodiment of the invention a secondary fluid circuit is located between the process air circuit and the heat-emitting heat exchanger of the heat pump, the dried, cooled process air is heated in a second heat exchanger, in which the process air circuit and the second secondary fluid circuit are in contact via a wall with the best possible heat-conducting properties. The heated process air is then in turn conveyed to the laundry drum as a drying chamber. Upstream of the second heat exchanger or preferably between the second heat exchanger and the laundry drum, the process air can additionally be heated by means of an electric heater.

The secondary coolant ("secondary fluid") is very particularly preferably water. As in this case it is possible to work in an almost unpressurized manner relative to environmental pressure, the heat exchangers between the heat pump and the process air circuit through which process air is flowing can be connected to the heat pump via, for example, quick-release couplings (similar to those used with articles for garden-watering purposes).

The secondary coolant, preferably water, used in the secondary fluid circuit is generally fed via an external inlet (water inlet).

In a preferred embodiment, in which water is used as the secondary coolant, the condensation water arising during the drying process is used, at least in part, as secondary coolant.

The temperature of the secondary coolant and the temperature of the primary coolant are generally kept within the permissible range via the controller of the heat pump. If in the case of the inventive condensation dryer, a heater is preferably located in the process air circuit before the entry into the drying chamber, control of the heat pump generally takes place in coordination with control of the heater.

It is preferable if the inventive condensation dryer has a first secondary fluid circuit and a second secondary fluid circuit, so that both heat exchangers of the heat pump are in each case connected with the process air circuit via a secondary fluid circuit.

It is particularly advantageous if the inventive condensation dryer has at least one removable heat exchanger. The removable heat exchanger can be the first and/or the second heat exchanger. According to the invention it is preferable for the first heat exchanger to be removable, since this has a greater tendency to soiling with fluff.

In a preferred embodiment of the inventive method two secondary fluid circuits are located between the process air circuit and the heat pump circuit, and heat is exchanged between the heat pump circuit and the process air via these.

Heat exchange between the heat pump circuit and the first and/or second secondary fluid circuit takes place in a particularly efficient manner if the coolant moves in a turbulent flow. The primary coolant preferably moves in a turbulent manner in the heat pump circuit. Nevertheless, by means of suitable constructional measures (guidance of the coolant within the circuit) or by means of suitable process-related measures (suitable conveying means) a turbulent flow can also be established in the secondary fluid circuit and/or in the process air circuit, instead of a laminar flow.

In general, the secondary fluid lines, except for the sections of lines located in the respective heat exchanger, are thermally insulated.

According to the invention it is preferable if process air and primary or, as the case may be, secondary coolant is directed through the heat exchangers using a cross-current or, as the case may be, counter-current method.

As the energy needed for drying purposes decreases with increasing dryness of the items to be dried in the condensation dryer, it is expedient to regulate the heater accordingly, that is to reduce its heating output with increasing dryness, in order to maintain an equilibrium between the drying energy supplied and that actually necessary. With the increasing dryness of the items to be dried, in particular laundry, a lower heating output or even an increasing cooling output of the heat pump is required. In particular after completion of a drying phase the temperature in the process air circuit would rise sharply. In general, therefore, the heat pump and the heater in the condensation dryer are controlled such that a maximum permissible temperature is not exceeded in the drying chamber.

The invention has numerous advantages. The long-term stability of condensation dryers with a heat pump is improved as a result of the use of secondary fluid circuits. A coefficient of performance of the heat pump circuit increases, while a minor reduction in the coefficient of performance as a result of the at least one secondary circuit (increase in the number of heat transfers) is more than outweighed by the elimination of the problems with soiled heat exchangers.

In the embodiment of the inventive condensation dryer in which an easily releasable connection of the secondary fluid feed or, as the case may be, outlet is provided, the heat exchangers through which the process air flows are very simple to dismantle and clean. The efficiency of the heat exchangers is thus retained.

In the inventive condensation dryer, the heat pump unit can be very compact, in particular being prefabricated from compressor, evaporator, throttle and condenser. After installation, only the secondary fluid lines need to be connected. The heat pump unit can thereby be manufactured far more simply and by automated means. This makes the manufacturing process more economical and enables a higher, more easily controllable manufacturing quality to be achieved.

Where very low-boiling coolants such as carbon dioxide are used, the placement of the heat exchangers for the process air is no longer subject to strict limitations due to the high-pressure lines of the coolant circuit.

In some embodiment variants the secondary fluid can also dissipate the waste heat from the compressor of the heat pump to the process air of the laundry dryer. The overall efficiency of the heat pump process and thus the energy balance of the entire drying method are thereby increased.

BRIEF DESCRIPTION OF THE DRAWINGS

A non-restrictive exemplary embodiment for a condensation dryer according to the present invention, in which the inventive method can also be carried out, is shown in FIG. 1.

DETAILED DESCRIPTION OF EXEMPLARY EMBODIMENTS OF THE PRESENT INVENTION

In the condensation dryer in FIG. 1, the heat pump is connected to the process air circuit via two secondary fluid circuits.

FIG. 1 shows a vertical section through a condensation dryer 1 (hereinafter referred to as "dryer" 1). The dryer 1 represented in FIG. 1 has a drum 3 which is rotatable around a horizontal axis, as a drying chamber 3, within which are fixed agitators 4 for moving laundry during a drum rotation. A heater 18, a first heat exchanger 11, 12, 13, a heat pump 13, 14, 15, 23, a second heat exchanger 16, 17 and a fan 19 are provided in order to generate a process air circuit 2, which is closed by an air duct 2, through the drum 3, to cool this after its passage through the drum 3, and after condensation of the moisture contained in the process air to heat it again. Here, air heated by the heater 18 is directed from the rear, that is from the side of the drum 3 opposite the door 5 of the dryer, through its perforated base into the drum 3, there comes into contact with the laundry to be dried, and flows through the loading aperture of the drum 3 to a fluff filter 6 within a dryer door which serves to close the loading aperture. The airstream is then deflected downward in the dryer door 5 and directed from the air duct 2 to the heat exchanger 11, 12. There, as a result of cooling, the moisture absorbed by the air from items of laundry condenses and is collected in a condensate container (not shown in FIG. 1), from which it can be disposed of. The heater 18 is optional; it is provided primarily in order to be able, upon actuation, to bring the components of the condensation dryer 1 and the items to be dried to the increased temperatures required for drying purposes as rapidly as possible. In stationary operation of the condensation dryer 1, use of the heater 18 is under certain circumstances no longer necessary.

In this case the cooling capacity of the heat pump 13, 14, 15, 23 is transferred via the secondary coolant, preferably water, circulating in a first secondary fluid circuit 12, 20. After the heat exchanger 11, 12, the process air is in turn directed to the heater 18 by the fan 19. Located between the fan 19 and the heater 18 is a second heat exchanger 16, 17, of the heat pump 13, 14, 15, 23, in which the process air is heated by means of the heat generated by said pump. Transmission of the heat here takes place via a second secondary fluid circuit 16, 21.

In the embodiment shown in FIG. 1, the drum 3 is mounted at the rear of the base by means of a pivot bearing and at the front by means of a bearing plate 7, the drum 3 resting with a flap on a sliding strip 8 on the bearing plate 7, and thus being held at the forward end.

Control of the condensation dryer takes place via a control device 10 which can be regulated by the user via an operator control unit 9; the control device handles, in a suitable manner, which is not described in greater detail here, all controllable components of the dryer 1, including in particular conventional sensors, which are also not shown here.

The heated secondary coolant of the first secondary fluid circuit 12, 20 is cooled in the evaporator 13 of the heat pump 13, 14, 15, 23. In the heat pump 13, 14, 15, 23, a primary coolant is evaporated in the evaporator 13, compressed in the compressor 14, and then condensed in the condenser 15 of the heat pump. The heat thereby released is used, via a second secondary circuit 16, 21, to heat the process air directed through the second heat exchanger 16, 17. From the condenser 15, the coolant passes through a throttle 23 back to the evaporator 14. To increase the energy yield, the waste heat from the heat pump circuit 13, 14, 15, in particular from the compressor 14, which is generally electrically powered, is fed into the process air (indicated by a dashed line in FIG. 1).

The invention claimed is:

1. A condensation dryer comprising:

a drying chamber for items to be dried;

a process air circuit along which process air can be driven via a fan and having a location at which process air is conducted into contact with the items to be dried;

a heat pump circuit for alternately heating and cooling the process air; and at least one secondary fluid circuit operatively coupled to the process air circuit and the heat pump circuit, the heat pump circuit being connected to the process air circuit via the at least one secondary fluid circuit, wherein the heat pump is configured and arranged to impart cooling or heating power to the process air circuit via the at least one secondary fluid circuit.

2. The condensation dryer as claimed in claim 1, wherein the secondary fluid circuit contains a secondary coolant which is fluid at room temperature and normal pressure.

3. The condensation dryer as claimed in claim 2, wherein the secondary coolant in the secondary fluid circuit includes at least one substance from the group of substances including water, simple alcohols and polyalcohols and glycol ethers.

4. The condensation dryer as claimed in claim 3, wherein the secondary coolant is water.

5. The condensation dryer as claimed in claim 1, wherein the heat pump circuit contains a primary coolant which is selected from a group including propane, isobutane, carbon dioxide and fluorohydrocarbon compounds.

6. The condensation dryer as claimed in claim 5, wherein the heat pump circuit has an evaporator, a compressor, a condenser, and a throttle.

7. The condensation dryer as claimed in claim 1 and further comprising a second secondary fluid circuit.

8. The condensation dryer as claimed in claim 7 and further comprising at least one removable heat exchanger associated with one of the secondary fluid circuits.

9. A method for operating a condensation dryer comprising:

conducting process air through a process air circuit that includes a passage through a drying chamber containing items to be dried;

alternately heating and cooling process air via a heat pump circuit at locations in the process air circuit external to the drying chamber; and exchanging heat between the heat pump circuit and the process air circuit via at least one secondary fluid circuit operatively coupled to the process air circuit and the heat pump circuit.

10. The method as claimed in claim 9, wherein exchanging heat between the heat pump circuit and the process air via at least one secondary fluid circuit operatively coupled to the process air circuit and the heat pump circuit includes exchanging heat between the heat pump circuit and the process air via two secondary fluid circuits operatively coupled to the process air circuit and the heat pump circuit.

11. A condensation dryer comprising:

a drying chamber for items to be dried;

a process air circuit along which process air can be driven via a fan and having a location at which process air is conducted into contact with the items to be dried;

a heat pump circuit for alternately heating and cooling the process air; and at least one secondary fluid circuit operatively coupled to the process air circuit and the heat pump circuit, wherein the secondary fluid circuit contains a secondary coolant which is fluid at room temperature and normal pressure, and wherein the secondary coolant in the secondary fluid circuit includes at least one substance from the group of substances including water, simple alcohols and polyalcohols and glycol ethers.

12. A condensation dryer comprising:

a drying chamber for items to be dried;

a process air circuit along which process air can be driven via a fan and having a location at which process air is conducted into contact with the items to be dried;

a heat pump circuit for alternately heating and cooling the process air; and at least one secondary fluid circuit operatively coupled to the process air circuit and the heat pump circuit, wherein the heat pump circuit contains a primary coolant which is selected from a group including propane, isobutane, carbon dioxide and fluorohydrocarbon compounds.

13. A condensation dryer comprising:

a drying chamber for items to be dried;

a process air circuit along which process air can be driven via a fan and having a location at which process air is conducted into contact with the items to be dried;

a heat pump circuit for alternately heating and cooling the process air; and at least one secondary fluid circuit operatively coupled to the process air circuit and the heat pump circuit, further comprising at least one removable heat exchanger associated with one of the secondary fluid circuits, and further comprising a second secondary fluid circuit.

* * * * *